United States Patent [19]

Ireland

[11] Patent Number: 4,516,814

[45] Date of Patent: May 14, 1985

[54] COUPLING DEVICE

[75] Inventor: Hugh C. Ireland, Ayr, Scotland

[73] Assignee: Simplex-GE Limited, Ayr, Scotland

[21] Appl. No.: 521,426

[22] Filed: Aug. 8, 1983

[30] Foreign Application Priority Data

Aug. 26, 1982 [GB] United Kingdom ..... 8224586
Oct. 26, 1982 [GB] United Kingdom ..... 8230568

[51] Int. Cl.[3] ..... H01R 35/00
[52] U.S. Cl. ..... 339/7
[58] Field of Search ..... 339/7, 5 R; 403/129, 403/131–132, 141–143

[56] References Cited

U.S. PATENT DOCUMENTS 348,708 9/1886 Willets et al. ..... 339/7
3,883,256 5/1975 Schmidt ..... 403/141
4,059,360 11/1977 Teissier ..... 403/141 X
4,140,413 2/1979 Conrad ..... 403/131 X

FOREIGN PATENT DOCUMENTS 653716 12/1962 Canada ..... 339/7
2420685 11/1979 France ..... 403/141

*Primary Examiner*—Eugene F. Desmond
*Attorney, Agent, or Firm*—Arnold B. Silverman

[57] ABSTRACT

A coupling device for establishing an adjustable electrically conductive connection between two members of an electrical installation comprises a ball member (17) which is axially adjustable on a coupling rod (19) and is formed with a radial slot (20) to enable it to be clamped onto the rod by the application of a clamping force exerted on the ball member (17) by means of clamping elements (21,22) which afford seatings (25,26) engaging the part-spherical surface of the ball member in such a manner as to permit universal adjustment, bolts (28) being provided to draw the plates towards one another so as on the one hand to apply clamping pressure to the ball member (17) thereby to clamp the latter onto the rod at an adjustable axial position and on the other hand to clamp themselves onto the ball member at a universally adjustable position in one and the same operation.

5 Claims, 7 Drawing Figures

FIG. I

COUPLING DEVICE

BACKGROUND OF THE INVENTION

1. Field of the Invention

This invention relates to a coupling device, and is particularly concerned with the provision, by means of the coupling device, of a facility for mechanical adjustment/alignment between coupled members which are maintained in electrically conductive connection by means of the coupling device. The invention is, for example, applicable for coupling a conductor rail and a terminal of a vacuum circuit breaker, but may also be employed in other electrical devices where similar needs arise.

2. Description of the Prior Art

U.S. Pat. No. 3,670,123 shows a typical type of coupling as conventionally used in a vacuum current breaker of the kind to which the present invention is applicable. No specific provision is made for adjustment of the coupling to compensate for misalignment of moving components in the current conductive path in order to provide a rigid connection with good electrical conductivity. Instead the couplings used previously employ a simple ball and socket joint with a certain degree of freedom which does not afford a good electrical connection with a sufficient degree of reliability.

SUMMARY OF THE INVENTION

According to the present invention, there is provided a coupling device comprising a first or inner electrically conductive member having connecting means for receiving a conductive coupling element and holding the latter securely whilst establishing a good electrical connection therewith, and a second or outer conductive member operable to clamp and hold the inner member securely whilst establishing a good electrical connection therewith, the inner and outer members having co-operative clamping surfaces such as to permit relative angular adjustment between the inner and outer members about an axis of revolution.

The inner member is conveniently a ball member of part-spherical configuration whereby universal adjustment of the inner and outer members about a centre of rotation is permitted.

The inner member may have a bore for receiving said coupling element preferably in an axially adjustable manner. In this case, the ball member is preferably formed with a slot to permit clamping of said coupling element in said bore by clamping pressure applied externally to the ball member. The slot in the ball member preferably extends radially outwardly from the bore in a plane containing the axis thereof.

The coupling element may be in the form of a rod secured within the bore by any convenient means, but preferably said bore is at least partially internally screw-threaded for engagement with a complementary screw thread on the coupling rod, whereby axial adjustment can be effected.

Preferably, the outer member comprises two clamping elements each having a part-spherical recess complementary to said ball member, the clamping elements being arranged with said recesses facing each other and embracing the ball member, releasable fastening means being provided to draw the clamping elements towards one another so as to clamp the ball member therebetween.

Further, the clamping elements and the fastening means may be so adapted and arranged that operation of the fastening means effects adjustment of clamping force in a direction transverse to the axis of the coupling rod. For this purpose, the clamping elements may be relatively movable by said fastening means in a direction transverse to the axis of said rod. Nevertheless, it is also possible for the clamping elements to be arranged for relative movement in a direction substantially parallel to the axis of the rod.

The coupling device preferably incorporates locating means associated with the clamping elements and adapted to maintain the clamping elements in close mutual registration during operation of the fastening means, thereby to reduce axial shifting of the coupling rod attributable directly to operation of the fastening means.

Further, according to the present invention, there is provided an electrical installation comprising a pair of relatively adjustable current carrying elements adjustably connected together in electrically conductive relation by means of a coupling device as aforesaid.

The present invention also affords a coupling device comprising an inner member having an external clamping surface of curved configuration, an internal bore to receive releasably an elongated member, and a slot extending outwardly from said bore to permit said inner member to be clamped onto a member in said bore, an outer member comprising two clamping elements having respective recesses which face towards one another and define clamping surfaces which engage the clamping surface of the inner member, and releasable fastening means operable to draw the clamping elements towards one another and thereby clamp said elements onto the inner member whilst simultaneously clamping the inner member onto a member in said bore.

BRIEF DESCRIPTION OF THE DRAWINGS:

Embodiments of the present invention will now be described, by way of example, with reference to the accompanying drawings, wherein.

DESCRIPTION OF THE PREFERRED EMBODIMENTS

Figure 1:
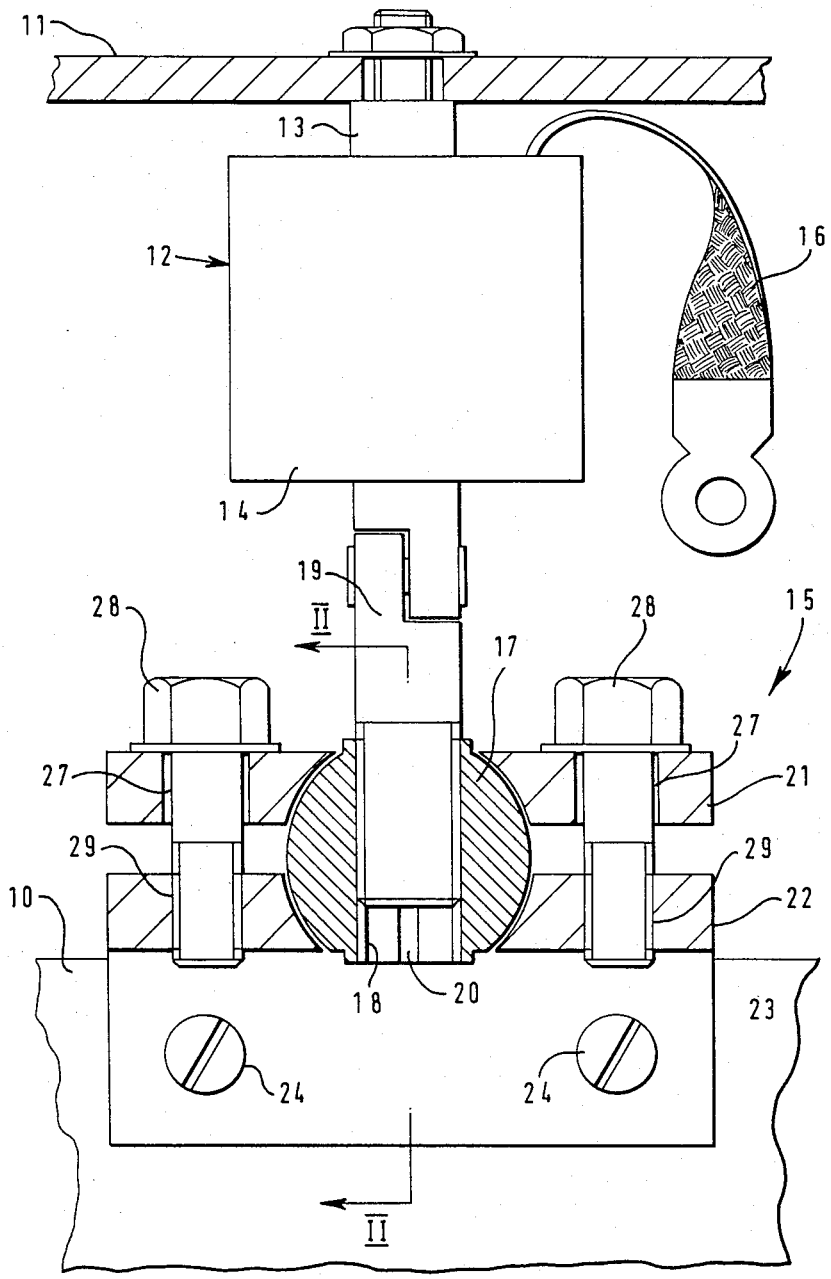
FIG. 1 is a part-sectional elevation of a part of an electrical installation incorporating a coupling device in accordance with the present invention.
Figure 2:
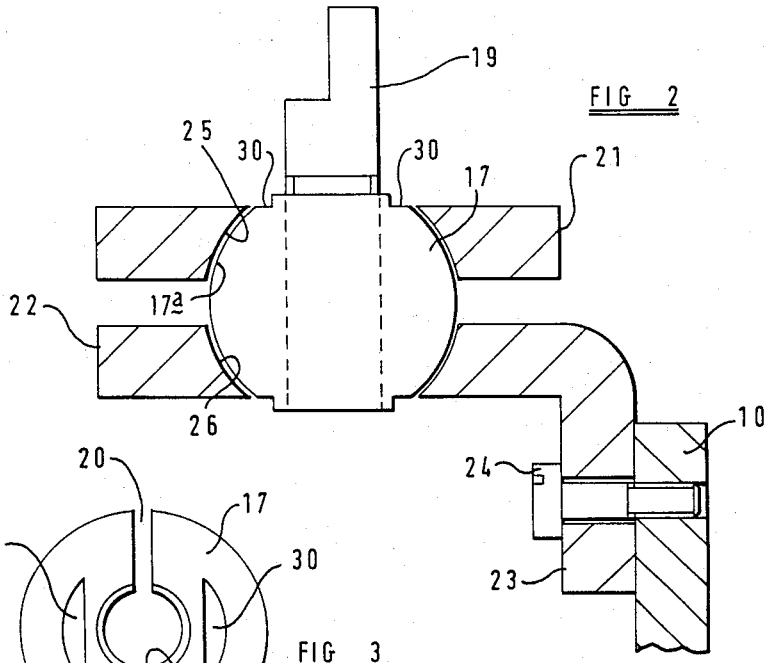
FIG. 2 is a part-sectional elevation on the line II—II of FIG. 1 showing inner and outer members of the coupling device.
Figure 3:
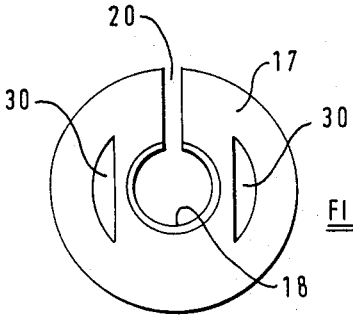
FIG. 3 is a plan view of the inner member of the coupling device of FIG. 2.
Figure 4:
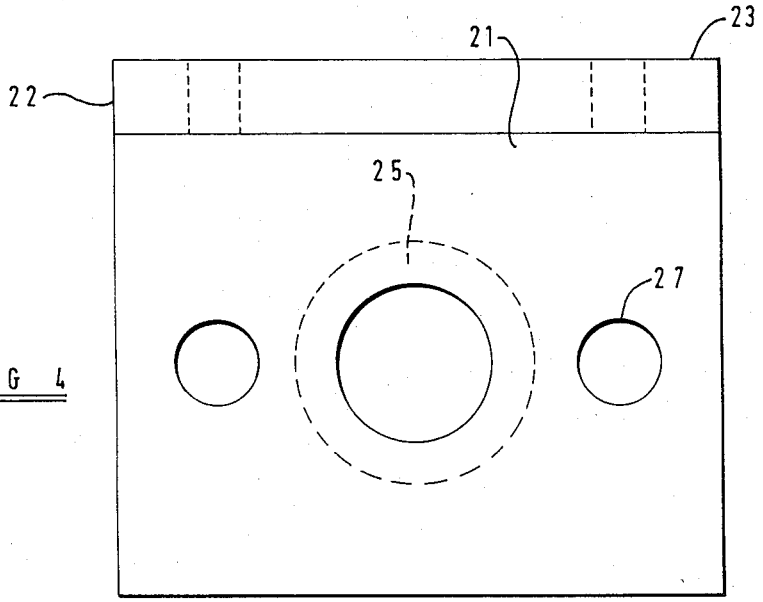
FIG. 4 is a plan view of the outer member of the coupling device of FIG. 2.

FIG. 1 of the drawings shows part of a typical electrical installation consisting of a fixed conductor rail 10, a movable actuator bar 11, and an electrical device 12 such as a vacuum circuit breaker. A shiftable plunger element 13 of the circuit breaker is fixedly secured to the actuator bar 11, and the body 14 of the circuit breaker is secured to the conductor rail 10 by means of the coupling device indicated generally by reference numeral 15.

The principal conducting path controlled by the circuit breaker includes a braided connector 16 and the coupling device 15 so that the latter is required to establish a good electrical connection as well as provide firm but adjustable mechanical support for the circuit breaker.

Electrical devices such as vacuum circuit breakers are not necessarily manufactured to close tolerances at least as regards the mutual axial alignment of the terminal and plunger portions. Accordingly, some difficulty has been experienced with previously proposed mounting or coupling arrangements. Moreover, positional adjustment of the circuit breaker bodily in the direction of its own axis with respect to a conductor rail simultaneously with a need to compensate for axial misalignment has also caused previous difficulties in practice. By means of the coupling device in accordance with the invention as described below, these difficulties are obviated or mitigated.

The coupling device 15 as illustrated consists of an inner ball member 17 having a screw-threaded central bore 18 which receives a screw-threaded lower portion of a coupling rod 19, the upper end of which is connected to the body 14 of the circuit breaker by means of a lug thereon as shown.

The ball member 17 is formed with a slot 20 extending generally radially from the bore 18, preferably, as shown, to the outside surface 17*a* of the ball member, thereby to permit clamping pressure applied externally to the ball member to effect clamping of the ball member onto the coupling rod in the bore 18. The coupling device 15 further consists of an outer member constituted by two clamping elements in the form of plates 21 and 22, the latter having a transverse flange 23 which is drilled to accommodate mounting screws 24 for securing the coupling device 15 to the conductor rail 10. Each of the clamp plates 21 and 22 is formed or provided with a partspherical recess, 25 and 26 respectively, the inner surfaces of which constitute clamping surfaces complementary with the external surface of the ball member 17. The clamp plate 21 is drilled at 27 to receive fastening bolts 28 which engage tapped holes 29 in the clamp plate 22 so that the clamp plates can be drawn towards one another to lock the ball member 17 and the coupling rod 19 together in one simple operation.

The recesses 25 and 26 are so dimensioned and shaped that when the clamp plates 21 and 22 are assembled with the ball member 17, the plates cannot be brought into direct face-to-face engagement by operation of the bolts 28. This ensures that the plates must grip the ball member and apply a clamping force which on the one hand maintains the plates, and the rail 10 by which they are carried, in an adjustable orientation relative to the axis of the rod, and on the other hand causes the ball member itself to be clamped to the rod 19 at an adjustable axial position.

The provision of a universal adjustment by means of the ball member 17 and part-spherical recesses 25, 26 in the clamp plates 21, 22 accommodates automatically any axial misalignment of the plunger 13 and body 14 of the device 12; and rotation one way or other of the ball member 17 by means of a suitable tool which engages a pair of opposed flats 30 formed on the ball member for this purpose facilitates axial adjustment of the body 14 of the circuit breaker. When correct position settings have been attained, the clamping bolts 28 are simply tightened.

However, with the coupling device of FIGS. 1 to 4, when the clamping bolts 28 are set such as to permit rotational adjustment of the ball member 17, there may be a relatively large degree of "play" of the ball member 17 relative to the clamp plates 21, 22 in the axial direction of the coupling rod. This arises because of the increased spacing of the clamp plates and may tend to mask fine axial adjustments of the position of the ball member on the rod. The degree of such play may be reduced by means of the following modification, which is described with reference to FIGS. 5 to 7. In these figures, parts corresponding to those already described are given the same reference numerals. The modification makes use of clamp plates which are relatively movable in a direction transverse to the axis of the rod, rather than parallel to such axis as in the embodiment described above.

Figure 5:
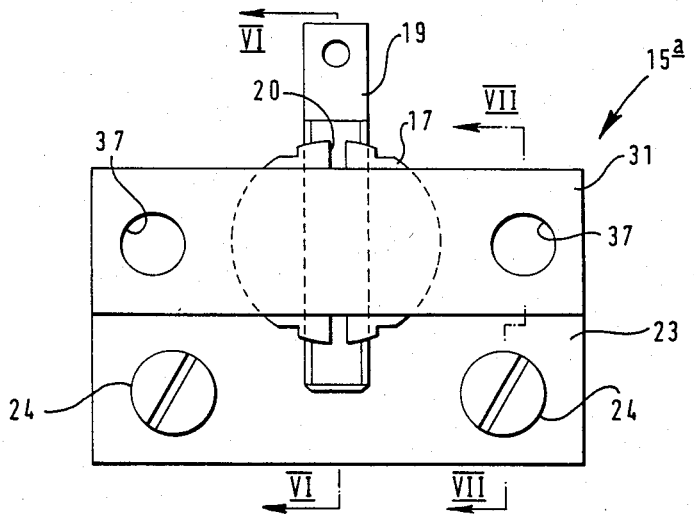
FIG. 5 is an elevation of a modified coupling device in accordance with the present invention.
Figure 6:
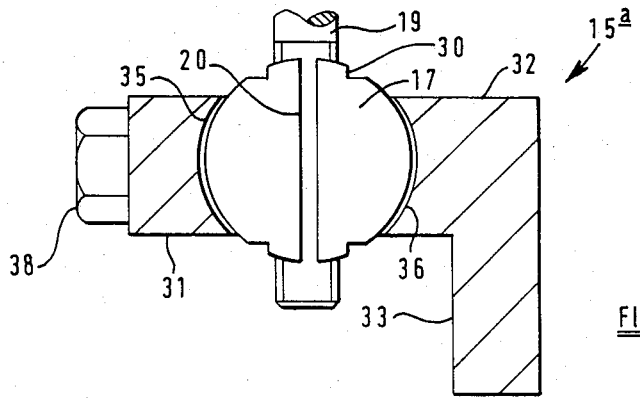
FIGS. 6 and 7 are respectively part-sectional elevations on the lines VI—VI and VII—VII of FIG. 5.
Figure 7:
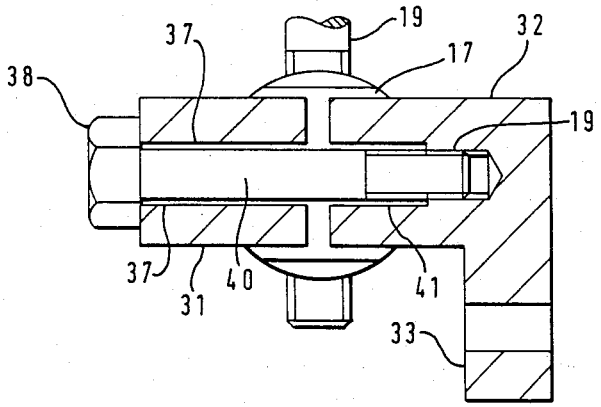

In FIGS. 5 to 7, the coupling device is denoted generally by reference numeral 15*a* and comprises an outer member constituted by two clamp plates 31 and 32, the latter having a flange 33 for the purpose described above in connection with the flange 23 shown in FIGS. 1 to 4. The clamp plates 31 and 32 have part-spherical recesses 35 and 36 constituting clamping surfaces, again similar to the arrangement described with reference to FIGS. 1 to 4, except that they are presented towards the axis of the rod 19, rather than longitudinally thereof.

The clamp plate 31 is formed with bores 37 on either side of the axis of the coupling rod 19 to receive fastening bolts 38 which are engageable in tapped holes 39 in the clamp plate 32 so as to be operable to draw the clamp plates 31 and 32 together and thereby clamp the ball member 17.

The modified coupling 15*a* further incorporates locating means associated with the clamp plates for keeping the latter in close mutual registration during operation of the fastening bolts 38. Thus, each fastening bolt 38 has a plain shank portion 40 which is received in close fitting engagement in the bore 37 in the clamp plate 31 and in a counter bore 41 in clamp plate 32. Thus, the shank 40, the bore 37, and the counter bore 41 effectively keep the clamp plate 31 in close registration with the clamp plate 32 even when the clamp bolts 38 are slackened sufficiently to permit rotational adjustment of the ball member 17, and the axial play permitted in the position of the ball member 17 is thus significantly less than compared with the arrangement shown in FIGS. 1 to 4. However, as in that arrangement, the recesses 35 and 36 are so dimensioned and shaped that the clamp plates 31 and 32 cannot be brought into direct fact-to-face engagement with each other.

In a further modification, locating means separate from and additional to the clamping bolts may alternatively be employed. For example, a modified locating means may consist of a locating slide extending transversely from one clamp plate and engaging in parallel guides afforded by the other clamp plate.

In a further modification of either of the described coupling devices, the screw threads in the bore 18 and on the coupling rod 19 may be dispensed with, and instead separate means may be provided for adjusting the axial position of the ball member 17 on the rod 19. For example, a locking nut mounted on the rod 19 may engage the ball member either directly or through an appropriately shaped seating.

Since it is envisaged that the coupling device would not normally require adjustment after the installation has been set up correctly, the ball member could be formed without the slot 20, providing the material of which it is made is sufficiently malleable to enable it to clamp the rod effectively in response to the clamping force applied by the clamp plates.

Further, whilst the ball member 19 is shown with a slot 20 which extends completely to the exterior surface thereof, in some circumstances the slot may extend only part-way from the ball to the exterior surface. Further, it would be possible for the slot 20 to extend across the whole diameter of the ball member so that the latter is of split construction and the two parts are held together by the associated clamp plates. Again, whilst it is preferred that both the inner and outer coupling members afford partspherical clamping surfaces, it will be appreciated that one of such surfaces could be of some other shape, for example frusto-conical.

Whilst it is preferred that the clamping surfaces are of part-spherical shape so as to facilitate universal adjustment about a centre of rotation, it would be possible where so required in any particular application to utilise clamping surfaces of cylindrical or part-cylindrical shape so as to provide adjustment about a single axis of rotation which may or may not be substantially coincident with the axis of the rod.

It will be appreciated that since the coupling device is intended to form part of an electrically conductive path, the inner and outer members thereof will be preferably made of a good electrical conductor such as copper.

Whilst the invention has been described specifically in relation to an electrical device such as a vacuum circuit breaker, it will be appreciated that the coupling device may be used in electrical installations incorporating other devices where similar requirements arise.

I claim:

1. An adjustable electrical connection comprising first and second electrical conductors each carrying respective first and second members of an electrically conducive coupling, said first conductor has an externally screw-threaded part;

said first coupling member has an external clamping surface of curved configuration, an internal screw-threaded bore in which said threaded part of the first conductor is threadedly received in an axially adjustable manner, and a slot extending outwardly from said bore; and said second coupling member comprises two clamping elements having respective recesses which face towards one another and define clamping surfaces which engage the clamping surface of the first coupling member over a range of positions of engagement, and releasable fastening members which are operable to draw the clamping elements towards one another and thereby clamp said elements onto the first coupling member and hold said surfaces at any selected position of engagement whilst simultaneously clamping the first coupling member onto said threaded part of the first conductor and holding said threaded part at any selected axial position.

2. An electrical connection according to claim 1 wherein at least one of said clamping surfaces afforded by said first or said second coupling member is of part-spherical form so as to permit universal relative adjustment of said first and second coupling members about a center of rotation.

3. An electrical connection according to claim 1 wherein the clamping elements are relatively movable by said fastening means in a direction substantially parallel to the axis of said bore in said first coupling member.

4. An electrical connection according to claim 1 wherein the clamping elements are relatively movable by said fastening means in a direction substantially transverse to the axis of said bore in said first coupling member.

5. An electrical connection according to claim 1 wherein the clamping elements are associated with locating members which are adapted and arranged to maintain the clamping elements in close mutual registration during operation of the fastening means.

* * * * *